US012503261B2

(12) United States Patent
Kreis et al.

(10) Patent No.: US 12,503,261 B2
(45) Date of Patent: Dec. 23, 2025

(54) METHOD, APPLICATION DEVICE, AND PACKAGING DEVICE FOR PRODUCING STRAPPED PACKAGES

(71) Applicant: Krones Aktiengesellschaft, Neutraubling (DE)

(72) Inventors: Marcus Kreis, Kolbermoor (DE); Herbert Spindler, Niedermoosen (DE); Peter Haidacher, Kiefersfelden (DE); Florian Saumweber, Rosenheim (DE)

(73) Assignee: Krones Aktiengesellschaft, Neutraubling (DE)

( * ) Notice: Subject to any disclaimer, the term of this patent is extended or adjusted under 35 U.S.C. 154(b) by 88 days.

(21) Appl. No.: 18/699,423

(22) PCT Filed: Sep. 13, 2022

(86) PCT No.: PCT/EP2022/075408
§ 371 (c)(1),
(2) Date: Apr. 8, 2024

(87) PCT Pub. No.: WO2023/061680
PCT Pub. Date: Apr. 20, 2023

(65) Prior Publication Data

US 2024/0409261 A1 Dec. 12, 2024

(30) Foreign Application Priority Data

Oct. 12, 2021 (DE) ..... 10 2021 126 398.0

(51) Int. Cl.
*B65B 27/04* (2006.01)
*B65B 13/02* (2006.01)
*B65B 13/20* (2006.01)

(52) U.S. Cl.
CPC ..... *B65B 27/04* (2013.01); *B65B 13/022* (2013.01); *B65B 13/20* (2013.01)

(58) Field of Classification Search
CPC ..... B65B 27/04; B65B 13/022; B65B 13/20; B65B 17/025
See application file for complete search history.

(56) References Cited

U.S. PATENT DOCUMENTS 3,186,333 A 6/1965 Hoffman et al.
3,404,505 A * 10/1968 Hohl ..... B65B 27/04 53/399

(Continued)

FOREIGN PATENT DOCUMENTS

DE 102019113179 A1 11/2020
DE 102019113181 A1 11/2020
DE 102020207930 A1 12/2021

OTHER PUBLICATIONS

PCT Application: PCT/EP2022/075408 Filed Sep. 13, 2022—International Preliminary Report on Patentability dated Apr. 25, 202.

(Continued)

*Primary Examiner* — Andrew M Tecco
*Assistant Examiner* — Nicholas E Igbokwe
(74) *Attorney, Agent, or Firm* — Simmons Perrine PLC

(57) ABSTRACT

The invention relates a method using an application head for grouping articles that are held together by a strapping band. The method includes: providing the at least two grouped articles; inserting a prefabricated closed strapping band into the application head, wherein the strapping band is fixed in a defined position. The application head has a variable opening width of a cage which surrounds the grouped articles. It is then lowered over the articles by a feed movement which runs approximately parallel to longitudinal central axes of the articles, wherein the cage contacts the grouped articles and slightly compresses the grouped articles. The strapping band is then positioned by lowering the application head. The opening width of the cage is then (Continued)

increased while the strapping band is simultaneously released. Then the application head is raised over the strapped article grouping and is removed therefrom.

14 Claims, 12 Drawing Sheets

(56) References Cited

U.S. PATENT DOCUMENTS 3,509,684 A * 5/1970 Scribner ..... B65B 17/025 53/142
3,714,756 A * 2/1973 MacInnes ..... B65B 27/04 53/543
4,454,705 A * 6/1984 Benno ..... B65B 13/022 53/399
7,428,865 B1 * 9/2008 Kasel ..... B65B 27/10 53/529
8,443,723 B2 * 5/2013 Liu ..... B65B 27/086 100/29
2011/0056174 A1 * 3/2011 Perl ..... B65B 13/02 53/391
2014/0075885 A1 * 3/2014 Perl ..... B65B 13/02 53/399
2014/0216661 A1 8/2014 Sugimoto et al.

OTHER PUBLICATIONS

PCT Application: PCT/EP2022/075408 Filed: Sep. 13, 2022—International Search Report and Written Opinion dated Feb. 24, 2023.
Priority Application: DE 10 2021 126 398.0 Filed: Oct. 12, 2021—German Search Report dated Feb. 28, 2023.

* cited by examiner

METHOD, APPLICATION DEVICE, AND PACKAGING DEVICE FOR PRODUCING STRAPPED PACKAGES

CLAIM OF PRIORITY

The present application claims priority to International Application PCT/EP2022/075408 dated Sep. 13, 2022, which in turn claims priority to German Application DE 10 2021 126 398.0 dated Oct. 12, 2021, which are incorporated by reference.

FIELD OF THE INVENTION

The present invention relates to a method for producing strapped packages, each of which is made of at least two grouped articles that are held together by at least one strapping band. The invention also relates to an application device for producing such strapped packages and to a packaging device for producing such strapped packages.

BACKGROUND OF THE INVENTION

Various options are known for combining individual articles into larger packages. For example, beverage containers are usually combined and packaged using shrink films to form packages of four, six or more beverage containers. The production of packages is usually indispensable, because they are the most common variant of sales units for beverage containers (such as bottles made of PET plastics material). In some cases, the containers are combined again for transport and/or assembled and palletized in layers.

The shrink films used to produce known packages require certain manufacturing steps with relatively high energy consumption. In addition, the shrink film used incurs costs for producing, provision, handling as well as later disposal, since it is no longer required after sale. The machine configuration for providing the so-called film wrapping modules and other handling stations also incurs high investment costs. Finally, a relatively high investment of capital is also for the provision of the so-called shrink tunnel, with which the shrink film wrapped around the package is shrunk around the bottles by hot air application.

Alternatively, strapped packages are known with which a plurality of articles are held together by strapping that is stretched horizontally around the outer sides of the articles, which strapping is placed around the articles during an uninterrupted conveying process and is then fixed in place. The strapping is thereby made of at least one strip stretched around the outer sides of the articles and subsequently connected at its ends under pre-tension. For example, in continuous or cyclically operating strapping machines, containers, articles or bottles are grouped into formations and are then strapped with one or more bands using strapping assemblies. Typical formations can be, for example, 1×2 arrangements (two containers in a row), 2×2 arrangements (four containers in a square or diamond formation), 3×2, 4×3 or in principle also variable n×m arrangements.

The production of strapped packages is described, for example, in German application no. DE 10 2009 040 700 A1.

The disadvantage here is that the strapping is connected to a closed strapping band on the articles. In particular, additional process time is required to produce a stable connection, which is a huge disadvantage with regard to the necessary production time and machine performance, in particular in the case of continuous processing. In addition, any function required on the closer tool to produce the closed strapping increases the complexity of the packaging process and the tools used.

The object of the invention is to optimize the strapping process, in particular to make the strapping process cost-effective, safe and rapid.

The above object is achieved by a method, an application device, and a packaging device for producing strapped packages, which have the features of the independent claims. Further advantageous embodiments are described by the dependent claims.

SUMMARY OF THE INVENTION

The invention relates to a method for producing strapped packages. A strapped package is in each instance made of at least two grouped articles that are held together by at least one strapping band. In this case, a tool, in particular an application head, is used to attach a closed strapping band to a combination of at least two grouped articles.

The strapping band can in particular be made of a paper material, a paper-like material, a plastics material, a composite material or the like. The strapping band encircles the article group, wherein the strapping band is arranged in a tensioned manner around regions of the outer lateral surfaces of the articles. The strapping band has a circumference that provides sufficient band tension to hold together and stabilize the group of articles.

In contrast to the known prior art, in particular a closed strapping band is used, i.e., it is no longer necessary to make a connection between free end regions of the strapping material on the article group.

The articles to be combined are preferably containers filled with a liquid content, for example bottles or cans, in particular beverage containers. However, the bottles or cans or similar containers can also be filled, for example, with liquid cosmetics such as shampoo or the like.

The method has at least the following method steps:

a) providing the at least two grouped articles, which are positioned in a movement and/or handling area of an application head, b) inserting at least one prefabricated closed strapping band into the application head, in which the closed strapping band is fixed in a defined position, which application head has a variable opening width of a cage that can surround the outer surface of the grouped articles, c) feeding the application head equipped with the at least one strapping band to the articles by a feed movement which runs approximately parallel to longitudinal central axes of the articles or wherein the grouped articles can be fed to the application head by a feed movement which runs approximately parallel to longitudinal central axes of the articles, wherein the cage of the application head contacts the grouped articles on the outer surface thereof and at least slightly compresses the grouped articles, d) positioning the strapping band at a provided position of the articles by lowering the application head, which is simultaneously compressing the articles, in a defined manner, e) increasing the opening width of the cage of the application head while the at least one strapping band is simultaneously released and removed from its fixed position within the application head, and subsequently f) raising the application head over the strapped article grouping and removing it therefrom.

When reference is made to feeding the application head to the articles, this may mean lowering the application head equipped with the at least one strapping band over the articles. Alternatively, it can also describe a relative movement between the application head and the article group, which can take place by lifting the article group and threading it into the application head from below.

In this case, it is preferably provided that the compression applied to the lateral surfaces of the articles increases as the application head is lowered in a defined manner according to method step c) with increasing depth of the stroke until the desired compression is achieved. The stroke required for this purpose is defined, for example, by the design of a compression slope, described below, on contour pieces of the application head. As the downward movement progresses, the strapping band inserted into the application head is pushed over the compressed article group.

Of course, this also applies analogously if the article group is inserted into the application head by lifting it from below.

When the desired position of the strapping band relative to the articles is reached, the downward movement of the application head or the upward movement of the article group is stopped.

Now, the at least one strapping band is released and removed from its fixed position within the application head by eliminating the fixing of the strapping band by the fixing elements of the application head.

Subsequently or substantially simultaneously, the opening width of the cage of the application head is increased, in order to eliminate the compression of the articles.

With the method, a closed strapping band is thus temporarily fixed in the cage of the application head, wherein, due to the compression of the articles, an outer circumference of the article group is at least temporarily reduced, and in particular is smaller than the circumference of the strapping band, so that there is at least temporarily an at least slight distance between the article group arranged within the movement and/or handling area of the application head and the strapping band fixed within the application head.

According to one embodiment, it is provided that the compression of the cage is eliminated once the strapping band is positioned at its provided target position on the article grouping. At the same time, the fixing of the strapping band in the application head is eliminated, so that after expansion of the articles into their initial state, the application head rests against the group of articles with a provided pre-tension. In this way, the strapping band tension can be adjusted by the elastic restoring forces of the compressible articles, without requiring additional devices to apply an intended band tension and/or to connect the two open band ends.

Further tests have also shown that an additional position in the application head or within the cage can be favorable for inserting the banderole. In this case, the vertical flash face of the clamp moves slightly in the direction of the package center at the corners and sides, so that the strapping band can always be reliably inserted behind the vertical flash face. Then, the clamps can be moved into their respective operating positions and the banderole can be clamped.

The method can also provide that the closed strapping band is produced inline from a strapping material provided in strip form and is arranged and temporarily fixed immediately thereafter in the application head. In particular, a closed strapping band is produced from a strapping material provided in strip form and is positioned in the application head immediately thereafter. Pre-assembled strapping band portions are preferably produced, connected at their band ends and only then inserted into the application head. This allows the application head to be relatively simple in design, eliminating the need for band guide apparatuses and cutting and closing apparatuses.

Furthermore, it can be provided that the strapping material is provided with individual printing during the course of the formation of closed strapping bands or during the positioning of the strapping band in the application head. Such a variable printing possibility opens up a wide range of applications to give the band a colored design, to apply product information in clear text or encoded form, etc.

The method described above is carried out in particular in an application device described below. The application device is associated with a movement and/or handling area for an application head for cooperation with at least two articles grouped within the movement and/or handling area.

The application head is designed to attach at least one strapping band to an article group, wherein the strapping band is arranged on the group of articles in a partially wrapping manner on the outer lateral surfaces of the articles.

The application head has a cage having a variable opening width, which can surround the outer surface of the grouped articles. In particular, the cage is segmented and the opening width of the cage can be changed by feed movements of the segments, in particular by opening movements of individual segments directed perpendicularly away from the lateral surface of the articles or perpendicularly to the article longitudinal axis, wherein a rotational movement and a combination of rotational and translational movements are also conceivable. As a result, after the band has been separated from the cage, the cage can be relatively easily separated from the strapped article group, without compromising or damaging the packaging unit or any part of the packaging unit.

At least a part of the segments is preferably formed by contour pieces described below.

The cage furthermore has a region for inserting at least one prefabricated closed strapping band. For example, the application head or the cage is equipped with fixing apparatuses and guiding or holding elements. The fixing apparatuses and guiding or holding elements are in particular necessary for the correct placement and securing of the strapping band in the application head.

The fixing apparatuses can in particular be formed by clamping elements, suction elements, vacuum grippers and/or adhesion grippers.

On its inner circumference, the cage has a contoured guide that is formed, for example, by the contour pieces, clamping elements, and guiding or holding elements. The contoured guide is formed in particular at the corner radii and forms the circumference and the shape of the strapping band to be applied to the articles.

In particular, the contoured guidance of the cage provides the ring shape of the strapping band. Temporary fixing of the strapping band within the cage is necessary to keep it in position or in the required ring shape during the application process and to ensure correct pulling of the strapping band onto the article group. In this case, the fixing elements can either be distributed along the circumferential contour or are specifically located at distinctive points, for example in the region of the corner radii or the like.

For example, a contoured clamp having a vertical flash face or an undercut can be provided, in which undercut the strapping band is at least partially arranged. As a result, the strip is held reliably in the cage on the one hand, but can also easily be separated from the cage once it is positioned on the article group.

Preferably, the strapping band is inserted into the application head in such a way that the part of the strapping band with the connection point of the free ends of the strapping material, in particular the adhesive point or welding point or the like, is placed on a side of the part arranged perpendicular to the subsequent transport direction of the strapped package. As a result, the connection point at which the free end regions of the strapping band optionally overlap one another is prevented from hanging on guide strips of subsequent handling modules or the like, and the strapping band is prevented from tearing accordingly.

In order to compress the articles during the strapping operation, the contour pieces are beveled in the feed direction, in particular in the lowering direction onto the article group or in the attachment direction, so that during the downward movement of the application head in the direction of the article longitudinal axis or during the upward movement of the grouped articles in the direction of the article longitudinal axis, a compression is exerted on the articles arranged in the application head, in the course of which the closed strapping band can be applied to the grouped articles.

By opening the cage while the at least one strapping band is simultaneously released and removed from its fixed position within the application head, the strapped package formed in this way is released for subsequent handling. In particular, when the cage is opened, an opening width thereof is adjusted, in particular increased.

For example, the compression is eliminated by an outwardly directed movement of the contour pieces. At the same time, the fixing of the strapping band in the application head is released, so that the strapping band is wrapped around the outer lateral surfaces of the now loosened grouped articles.

The outward movement of the contour pieces can thereby be radial to a center point of the application head. Alternatively, contour pieces arranged opposite one another can be removed from one another by an opposing movement.

In particular, in an operating mode, the application head has a first opening width that is at least in regions at least smaller than a width of the article group, so that the article group is at least slightly compressed. In contrast, the region of the application head in which the strapping band is arranged has a width that corresponds to the width of the uncompressed article group.

In a release mode, on the other hand, the application head has a second opening width that is greater than a width of the uncompressed article group and also greater than a width of the strapping band fixed in the application head, so that the strapped article group, which is also referred to below as a strapped package, is released.

According to one embodiment, the application head located in the release mode is lifted off the strapped package against the application direction and is moved back to an initial position for reloading with a strapping band. The strapped package is released by lifting and can now be supplied for further handling, for example palletization or the like.

Alternatively, the strapped package is removed by lowering it from the application head located in the release mode and supplied for further handling, for example palletization or the like.

In addition, after the strapped package is released, the application head is transferred back to the operating mode with the first opening width by a corresponding feed movement of the segments, so that the application head can be reloaded with a strapping band.

Depending on the arrangement of the fixing elements, it may initially also be necessary to continue the downwardly directed movement of the application head after releasing the fixing of the strapping band from the fixing elements of the application head until the strapping band is arranged outside the fixing region and only then, under certain circumstances, to release the compression of the articles. In addition, to release the compression, it may also be necessary to move the fixing elements away from the strapped package, in order to avoid a collision when the application head is lifted with the strapped package.

To apply the compression, the application head can in particular be equipped with a plurality of correspondingly arranged contour pieces. In particular, the contour pieces represent at least partial regions of the contoured guide for the strapping band, in particular the shape of the corner regions of the strapping band is predetermined by the contour pieces.

The shape of the contour pieces is designed, for example, in such a way that they have an insertion region, a compression region and a region set back behind the compression region in the direction of the article longitudinal axis. The set-back region is in particular designed as a vertical flash face or undercut.

The strapping band is placed in each instance in the set-back regions of the contour pieces. This is necessary in order to prevent the strapping band from being placed on the outer lateral surface of the articles, which could result in premature hanging of the strapping band during the downward movement of the application head or the upward movement of the article group. In this case, the strapping band could be damaged, or correct application to the article group could be prevented.

The circumference of the strapping band is selected such that it is protected by the set-back region or undercut, but is not larger than necessary. When the compression is released, a strapping band would not produce sufficient tension between the strapping band and the article group. In particular, the friction between the articles would be lost, which would result in reduced package stability.

In addition, further tests have also shown that an additional position in the application head or within the cage can be favorable for inserting the sleeve. In this case, the vertical flash face of the clamp moves slightly in the direction of the package center at the corners and sides, so that the strapping band can always be reliably inserted behind the vertical flash face. Then, the clamps can be moved into their respective operating positions and the banderole can be clamped. The same also applies to the packaging device described below, which works with such an application head for producing strapped packages.

The compression applied to the individual articles of the article group is defined by the geometry of the contour piece. The amount of compression is defined by the difference between the compression radius for the corresponding compression axis and the uncompressed article radius. The contour piece can in particular have a radius for the compression longitudinally to the article group and/or a radius for the compression transversely to the article group.

The compression is always applied in at least one direction to the article group. In general, the compression is applied longitudinally to the article group. Alternatively, however, compression can also be applied transversely to the article group. A combination in both compression axes is also possible, i.e., a compression longitudinal to the article group and a compression transverse to the article group.

In the case of compression in one axis, the inner contour of the contour piece is designed so that, starting from the compression radius, the radius decreases to the uncompressed radius, so that the articles are guided only in this axis. In the case of biaxial compression, the corresponding compression radii can be selected to be different. In addition to the geometry of the contour pieces, an additional adjustment of the final compression can be carried out via a further infeed of the contour pieces to the article group.

The selected shape of the insertion slope, also referred to as compression slope, can influence how quickly the desired compression of the article group is achieved. In particular, this determines how much downward stroke of the application head is required. In addition, this also influences how much force must be applied for the compression, because, depending on the steepness of the compression slope, more or less friction is generated when the application head is pushed onto the article group.

Thus, by the height of the insertion region and the angle $\alpha$ of the compression slope, the geometry suitable for the corresponding group can thus be designed, in particular depending on the desired compression, the article geometry and the corresponding friction pairings.

The articles are pushed between the strapping band by the contour pieces of the application head, wherein, due to the compression of the articles, there is initially a certain distance between the strapping band held in the application head and the article group. Thus, there is initially a spatial separation between the strapping band and the articles, which is subsequently eliminated by the release of the compression.

A further embodiment can provide that the cage is equipped with compression devices in the form of pneumatically inflatable elements or in the form of sprung elements.

To transfer a prefabricated, closed strapping band to the application head, a transfer element is preferably provided that has the contour of the desired strapping band ring. The transfer element takes the ring-shaped strapping band from a corresponding magazine, a preparation module or the like. The transfer element is placed with the strapping band over the application head.

Preferably, the strapping band is fixed to the transfer element by suitable suction elements or clamping elements or other suitable fixing apparatuses, wherein the lower edge of the strapping band preferably protrudes at the bottom beyond the transfer element, so that the lower region of the strapping band can be inserted into clamping fixing elements of the application head. If the strapping band is held in the application head by suction elements only, a lower protrusion of the strapping band beyond the transfer element can be dispensed with.

By a downward movement of the transfer element and/or an upward movement of the application head, the strapping band held on the transfer element is placed in a desired arrangement within the application head. By closing and/or activating the fixing elements of the application head and opening and/or deactivating corresponding fixing apparatuses of the transfer element, the strapping band is transferred from the transfer element to the application head.

The transfer element is then removed from the application head by an upwardly directed movement of the transfer element or a downwardly directed movement of the application head and moved into a starting position for reloading with a further strapping band. In this case, it may be necessary to reduce the circumference of the transfer element, in order to allow for reliable removal from the application head. For this purpose, the transfer element can be segmented, wherein the segments can be moved toward a center of the transfer element, as a result of which a reduction of the circumference of the transfer element takes place.

Modifications are also conceivable here with which the strapping band is inserted into the application head from below by a corresponding transfer element and is arranged and fixed therein.

Preferably, the application head is designed such that different articles having the same or similar article geometry can also be processed therewith, even if the nominal diameter differs from the actual diameter of the articles. For this purpose, the desired compression must be adjustable in the longitudinal axis and in the transverse axes by positioning the contour pieces accordingly. In this way, defined similar diameter ranges can be covered in each instance.

The cage provided by the application head can also be enlarged or reduced and thus adapted to different pack sizes by inserting further guiding and holding elements or by removing guiding and holding elements.

With the method and the application device described herein, the use of a closed strapping band is particularly advantageous, so that the strapping band does not have to be glued or otherwise fixed to the article group. By using the correspondingly designed application head, the complexity of the strapping process can be reduced.

The invention further relates to a packaging device for producing strapped packages comprising an application device described above.

According to a preferred embodiment, the packaging device also comprises a device for producing closed strapping bands. The device for producing closed strapping bands is also referred to as a preparation module and comprises a magazine in which a supply of strapping material in strip form is provided.

The strapping material in strip form may be provided in the form of strips of strapping material provided in a defined length. However, the strapping material in strip form is preferably provided on a roll as endless material in a required width.

The device for producing closed strapping bands also comprises a connection device for connecting free ends of the strapping material in strip form to form a closed strapping band.

The pre-production of the strapping band starting from an endless material is described below. When using pieces of strapping material already cut to length, the corresponding separation step is omitted. That is to say, the corresponding device does not require a separating apparatus described below.

The endless strapping material is supplied via a feed apparatus to a separating apparatus. The feed apparatus consists, for example, of two rubberized rollers, at least one of which is driven, and which unwind the endless strapping material accordingly. The separating apparatus consists, for example, of a downstream knife or other suitable cutting unit.

The separating apparatus cuts strapping material to a defined length, and the free end regions of the strapping material cut to length are connected to one another to form the ring-shaped, prefabricated strapping band. In particular, the free end regions are thereby arranged partially overlapping and are connected to one another by gluing or a welding process or the like.

For example, the connection is made by a gluing unit comprising a glue application apparatus and a contact pressure apparatus to form an adhesive connection.

The gluing unit is preferably associated with a frame that maps the desired circumference of the strapping band to be formed in a recess along an inner or an outer circumference of the frame. The frame is associated with a circulating conveying unit.

The frame can, for example, be segmented and, by adjusting individual frame segments, the frame circumference can be adjusted and thus the circumference of the strapping band to be formed can be adjusted. This makes it possible to react to any circumferential variation of the article groups or to perform a format change with the same strapping material.

To transport the strapping material along an inner or an outer contour of the frame, one or more vacuum belts and/or mechanical conveying elements, for example circulating clamping elements, rubberized belts, conveyor belts or the like can be used.

The strapping material is conveyed once around the entire inner or outer contour of the frame by the conveying unit until an overlap is formed in the region of the gluing unit.

The cut-to-length strip of strapping material is provided with glue at the starting region and/or at the end region by the glue application apparatus and then pressed out by a contact pressure die of the contact pressure apparatus, thus creating a load-bearing connection.

The correspondingly closed strapping band can now be picked up by a transfer element in the manner described above and supplied to the application head of an application device for strapping an article group.

By integrating such a device for producing closed strapping bands into the packaging device, it is possible to react in an inline manner to changes in the circumference of the article groups. If the format changes, only the material needs to be changed if a different strapping material width is necessary. The costs for the preparation module are quickly recouped, because strapping material provided on rolls is much less expensive than specially prefabricated closed strapping bands.

In addition, in connection with the present invention, inline printing of the strapping material can be provided during the formation of a strapping band or during the application of the strapping band to the articles.

In particular, it is provided that a type of scattered print is applied as a basic print design on the strapping material. This is a printed image that repeats continuously at a defined interval. Ideally, the repeat interval is designed in such a way that it results in at least a complete repetition of the pattern per circumference of a closed strapping band for all formats to be processed, in particular package circumferences, in the corresponding width of the strapping material.

If, in addition, a package-specific print is to be present on the closed strapping band to be formed, an empty field is designed as a component of the scattered print. In this empty field, the desired printing can take place in an inline manner, for example in the form of a barcode, format information, best-before date, etc. For this purpose, in particular a printing unit arranged in the device for producing closed strapping bands can be provided, so that the desired printing takes place as part of the formation of the closed strapping band. Alternatively, a corresponding printing unit can also be associated with the application device, wherein the printing can take place before the closed strapping band is applied to the grouped articles or after the strapped package has been formed.

The inline print can be positioned within the empty fields by evaluating the unrolled length and back-calculating of the position of the empty field to be printed. Alternatively, sensor detection of the empty field or other markings present on the strapping material can be provided. For example, the detection of a special geometric marking that is a component of the scattered print or the like is conceivable.

The advantage of inline printing is that it reduces the amount of strapping material required, because it can now be used flexibly. This further reduces material costs, because the same strapping material can be used for different products.

It should be expressly mentioned at this point that all aspects and embodiment variants which have been explained in connection with the application device and/or packaging device according to the invention can also relate to, or be, partial aspects of the method according to the invention. Therefore, if the description or the claim definitions pertaining to the application device and/or packaging device according to the invention make mention of certain aspects and/or correlations and/or effects, this applies equally to the method according to the invention.

The same applies vice versa, so that all aspects and embodiment variants which have been explained in connection with the method according to the invention can also relate to, or be, partial aspects of the application device and/or packaging device according to the invention. Therefore, if the description or the claim definitions pertaining to the method according to the invention make mention of certain aspects and/or correlations and/or effects, this applies equally to the application device and/or packaging device according to the invention.

Exemplary embodiments of the invention and their advantages are explained in more detail below with reference to the accompanying figures. The proportions of the individual elements relative to one another in the figures do not always correspond to the actual proportions, since some forms are simplified, while other forms are shown enlarged in relation to other elements for better illustration.

Figure 1:
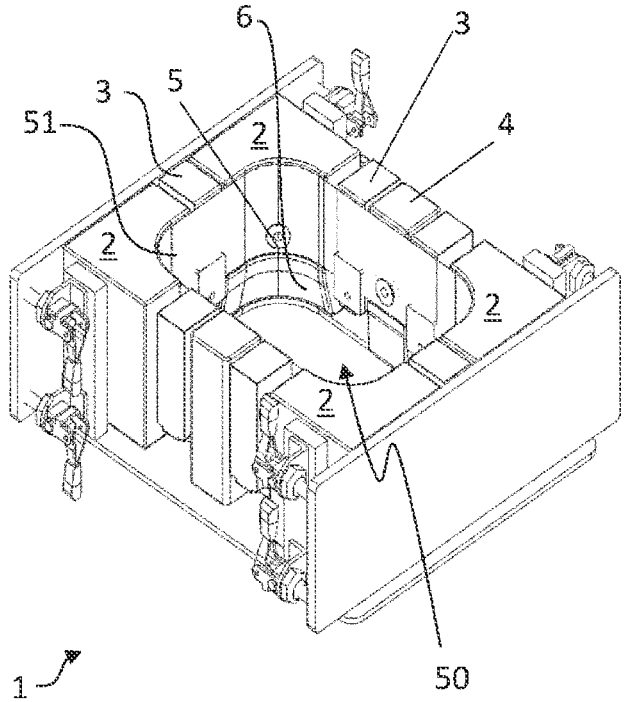
FIG. 1 shows a perspective representation of an application head of an application device for producing strapped packages.

Identical reference numerals are used for identical elements of the invention or those having the same effect. Furthermore, for the sake of clarity, only reference signs are shown in the individual figures, which are required for the description of the respective figure. The illustrated embodiments are merely examples of how the device according to the invention or the method according to the invention can be configured, and they are non-limiting.

DETAILED DESCRIPTION OF THE INVENTION

Figure 2:
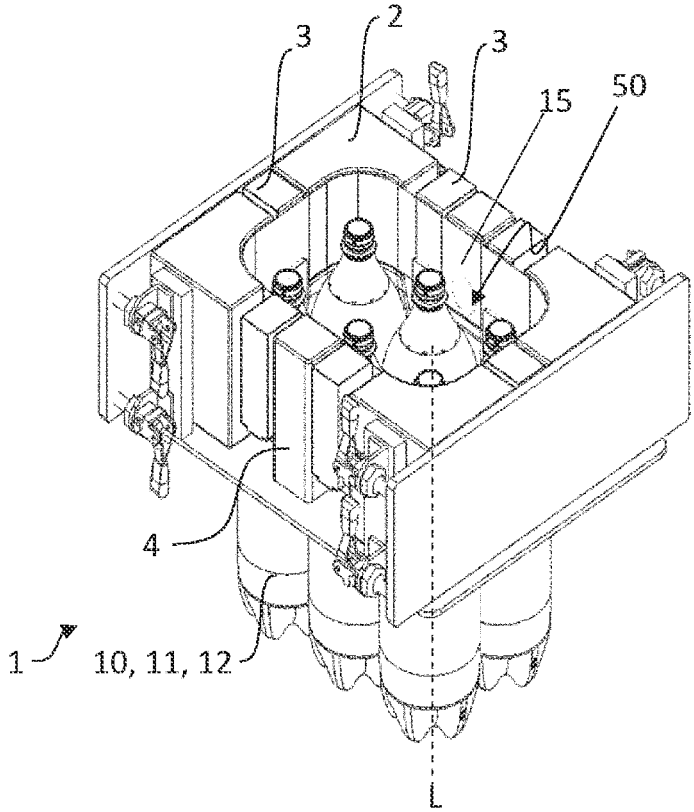
FIG. 2 shows an oblique perspective view from above of the application head according to FIG. 1 with an article grouping arranged therein, which is to be processed to produce a packaging unit.
Figure 3:
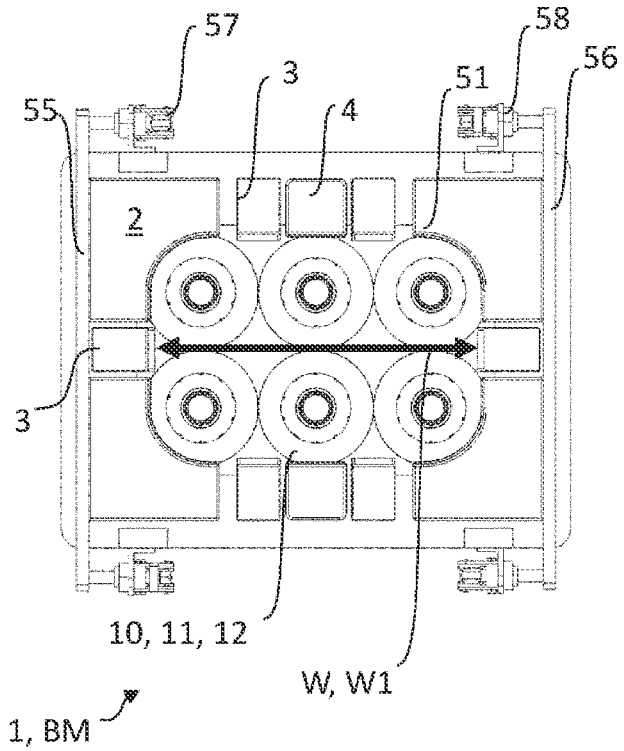
FIG. 3 to FIG. 5 show the application head according to FIGS. 1 and 2 in a representation from above.
Figure 4:
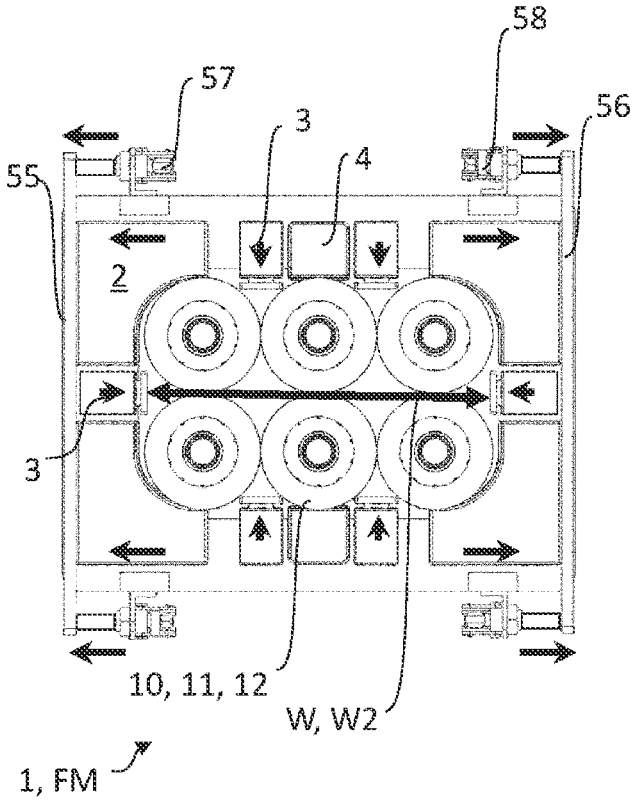
Figure 5:
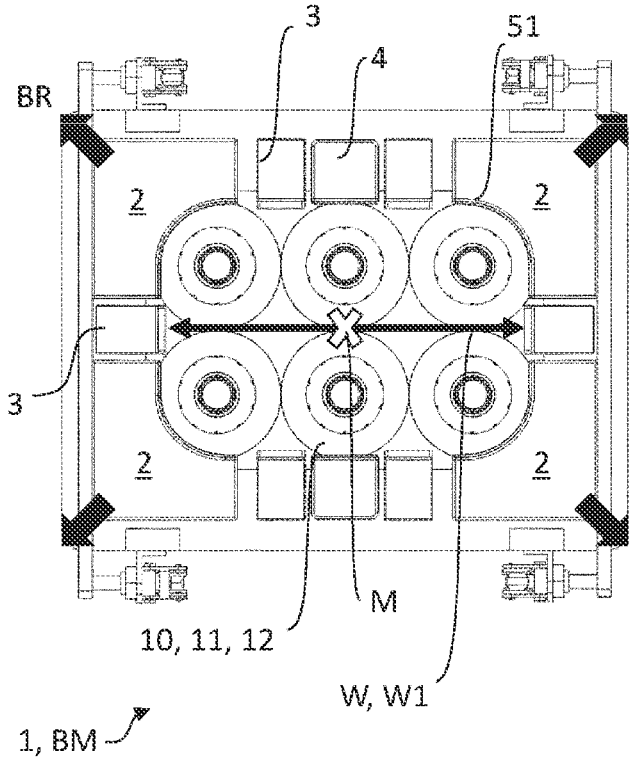
Figure 6:
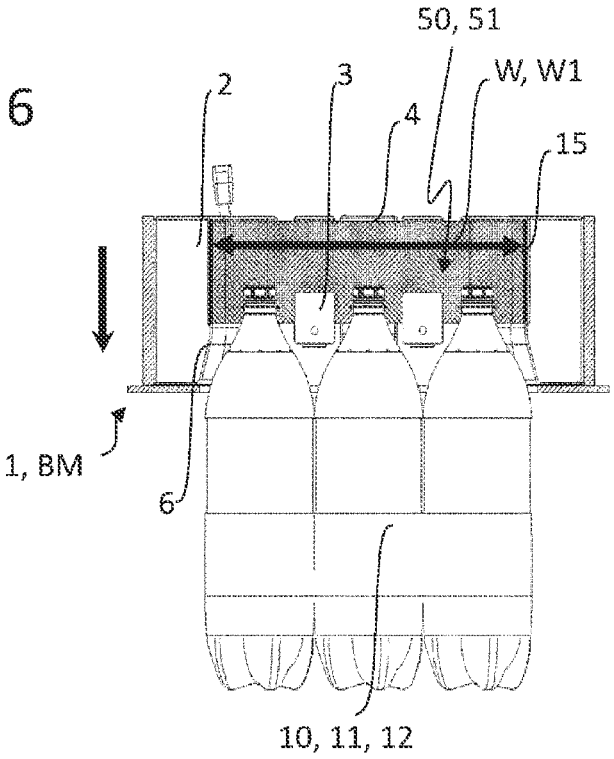
FIG. 6 to 12 show different steps of a method for producing strapped packages.

FIG. 1 and FIG. 2 show an application head 1 of an application device for producing strapped packages in a perspective representation. FIG. 3 to 5 also show the application head 1 according to FIGS. 1 and 2 in representations from above.

The application head 1 shown by way of example in FIG. 1 to 5 is provided and designed to attach at least one strapping band 15 to an article group 12 comprising at least two articles 10, wherein the strapping band 15 is attached to the outer lateral surfaces of the articles 10 in such a way that they are at least partially encircled by the strapping band 15, as a result of which the entire group 12 is also encircled and held together by the strapping band 15.

The strapping band 15, which holds the article group 12 together mechanically in this manner and is designed to be closed, can be formed in particular from a paper material, from a paper-like material, from a plastics material, from a composite material or the like. The material and the material thickness of the strapping band 15 then depend on the mechanical stability that is to be ensured to hold the article group 12 together.

The articles 10 to be combined are preferably containers filled with a liquid content, in particular beverage containers, for example bottles 11 or cans. However, the bottles 11 or cans or similar containers can also be filled, for example, with liquid cosmetics such as shampoo or the like. The schematic representation of FIG. 2 shows that the bottles 11 can be, for example, plastics containers for holding beverages, in particular PET containers.

The application head 1 has a cage 50 having a variable opening width W that is variable, can be adjusted by suitable actuators and can completely surround the outer surface of the grouped articles 10. In particular, the opening width W of the cage 50 can be changed by feed movements of a plurality of contour pieces 2 that are connected to one another but adjustable in their relative positions to one another. These contour pieces 2 form at least a part of the segments from which the cage 50 is formed.

The application head 1 comprises at least one contour piece 2 having a compression slope 6 designated as such here, the geometry of which is selected such that a downward movement of the application head 1 in the direction of the article longitudinal axis or an upward movement of the article group 12 in a direction parallel to the article longitudinal axes L causes compression to be exerted on the at least two grouped articles 10 (FIGS. 2 and 4) positioned within the movement and/or handling area of the application head 1 and in the course of which a closed, pre-produced strapping band 15 can be applied to the grouped articles 10. This means that the compression slopes 6 form a profile of the opening cross section of the cage 50 that is conical overall or extends toward a lower opening.

In the example shown, the cage 50 is formed by the contour pieces 2, the clamping elements 3 and the guiding or holding element 4. All of these parts are connected to one another, but can perform the relative movements described in more detail below relative to one another, in order to be able to vary the opening width of the cage 50 as needed. In particular, the cage 50 has a contoured guide 51 on its inner circumference, which is formed in particular at the corner radii. Furthermore, the inner contour of the cage 50 is beveled in particular in the region of the contour pieces 2 in the lowering direction onto the article group 12.

The application head 1 is also equipped with clamping elements 3 and guiding or holding elements 4 as well as suction elements 5. These clamping elements 3, guiding or holding elements 4 and suction elements 5 are necessary in particular for correct placement and securing of the strapping band 15 within the application head 1 (FIG. 2).

FIGS. 3 and 4 show the application head 1 with an article group 12 arranged therein comprising six articles 10, in particular six bottles 11, which are combined in a rectangular arrangement. According to FIG. 3, the articles 10 are partially compressed by the contour pieces 2 when the cage 50 is lowered over and surrounds the article group 12. The strapping band (not shown) is located in a clamping arrangement in the application head 1.

According to FIG. 4, the compression of the articles 10 is released by an outwardly directed movement of the contour pieces 2 as soon as the cage 50 together with the strapping band held therein is positioned at an intended height on the article group 12. In addition, the fixation of the strapping band within the application head 1 is released by a movement of the clamping elements 3 directed inward at least for a short time.

If the suction elements 5 are active suction elements 5 under negative pressure, the negative pressure applied to the suction elements 5 is released simultaneously with the inwardly directed movement of the clamping elements 3, as a result of which the strapping band held there can be separated.

In FIG. 3 to 5, the change in the opening width W is also shown. FIG. 3 shows the application head 1 in an operating mode BM with a smaller opening width W of the cage 50. In this operating mode BM, the articles 10 are strapped with the strapping band (not shown) arranged in the application head 1. In the operating mode BM, the application head 1 has a first opening width W1 that is at least in regions at least slightly smaller than a width of the article group 12, so that the group 12 is at least slightly compressed.

On the other hand, FIG. 4 shows the application head 1 in a release mode FM to which the application head 1 is transferred after the strapping operation has been connected, in order to release the strapped articles 10, which are referred to below as strapped packages and designated by the reference sign 13. In release mode FM, the opening manner of the cage 50 is accordingly increased compared to the operating mode BM (strapping mode). In this release mode FM, the application head has a second opening width W2 that is larger than a width of the article group 12, so that the group 12 is released.

In order to transfer the application head 1 from operating mode BM to release mode FM, contour pieces 2 arranged opposite one another are moved away from one another and thus distanced from the group 12 on both sides. In the present case, the contour pieces 2 arranged on the left are moved to the left and the contour pieces 2 arranged on the right are moved to the right, as a result of which the opening width W is increased.

In particular, the contour pieces 2 arranged on the left and the clamping element 3 arranged there between are associated with a first frame element 55, which can be moved by hydraulic or pneumatic adjustment devices 57. Furthermore, the contour pieces 2 arranged on the left and the clamping element 3 arranged there between are associated with a second frame element 56, which can be moved by hydraulic or pneumatic adjustment devices 58.

Alternatively, as shown in FIG. 5, the contour pieces 2 could be moved away from the center point M, in order to increase the opening width W.

Figure 11:
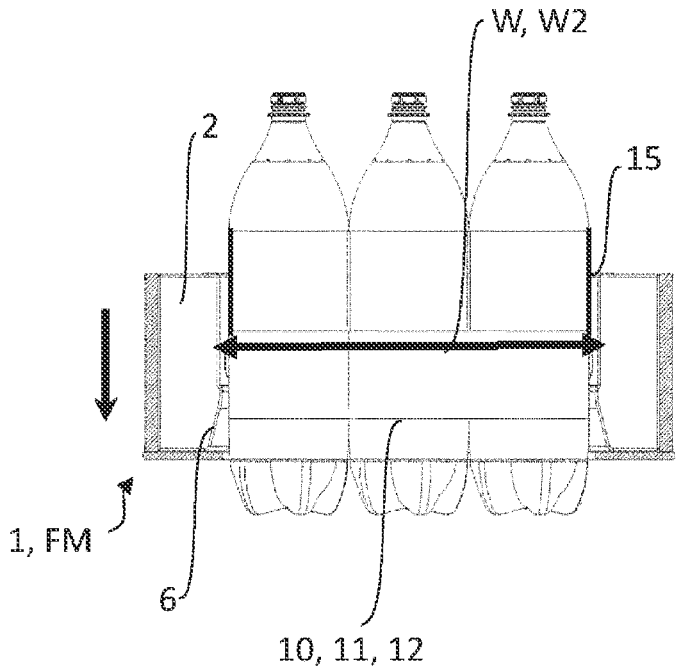

The schematic representations of FIG. 6 to 12 show different steps of a method for producing strapped packages 13, wherein the step shown in FIG. 11 is an optional step that can optionally also be omitted. FIG. 6 to 12 each show a sectional view through an application head 1 with articles 10 arranged therein, so that the different phases of forming the strapped packages from the mechanically interconnected article groups 12 can be illustrated.

In the context of the method, at least two grouped articles 10 are provided as an article group 12 and are positioned in a movement and/or handling area of the application head 1. In the example shown, six articles 10 are provided in two rows of three, wherein only one row of three is visible due to the sectional view.

In temporal connection with the provision of the articles 10 in the movement and/or handling area of the application head 1, either simultaneously or upstream, or immediately after the provision of the article group 12, at least one prefabricated closed strapping band 15 is inserted into the application head 1 and fixed in a defined position (see FIG. 6) in the application head 1 by the clamping elements 3. In particular, the at least one prefabricated closed strapping band 15 is inserted into the contoured guide 52 of the application head 1 and is fixed in a defined position (FIG. 6) in the contoured guide 52 of the application head 1 by the clamping elements 3.

The ring shape of the typically closed strapping band 15, which is prefabricated in the required length, is thus predetermined and maintained by the contour pieces 2 and the guide pieces 4 (see FIG. 1 to 5). In order to keep the strapping band 15 in position or in the required ring shape during the application process, the above-described clamping elements 3 and suction elements 5 or adhesion grippers, vacuum grippers or the like are provided, which ensure that the strapping band 15 is pulled onto the article group 12. These can either be distributed along the circumferential contoured guide 51 or specifically at distinctive points, for example in the region of the corner radii or the like. For example, a contoured clamp having a vertical flash face or an undercut, as described below in connection with FIG. 13 to 15, can be possible along the entire contoured guide 51 of the cage 50 of the application head 1 or also in parts.

Subsequently, the application head 1 equipped with the at least one strapping band 15 is lowered by a feed movement over the articles 10, wherein the cage 50 of the application head 1 contacts and at least slightly compresses the grouped articles 10 on their lateral sides of the articles 10.

When reference is made in the present context to a lowering of the application head 1 over the grouped articles 10, it can thus also mean lifting the grouped articles 10 from below into the application head 1 or, in general, a feed movement of the articles 10 and of the application head 1 with a direction of movement parallel to the longitudinal central axes of the articles 10. It should thus be clarified that these variants can also be understood from the formulation the lowering.

Figure 7:
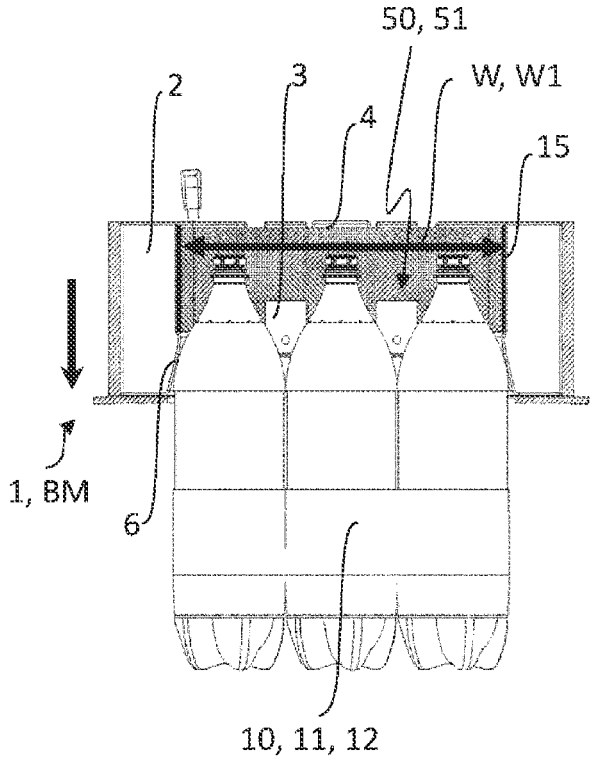
Figure 8:
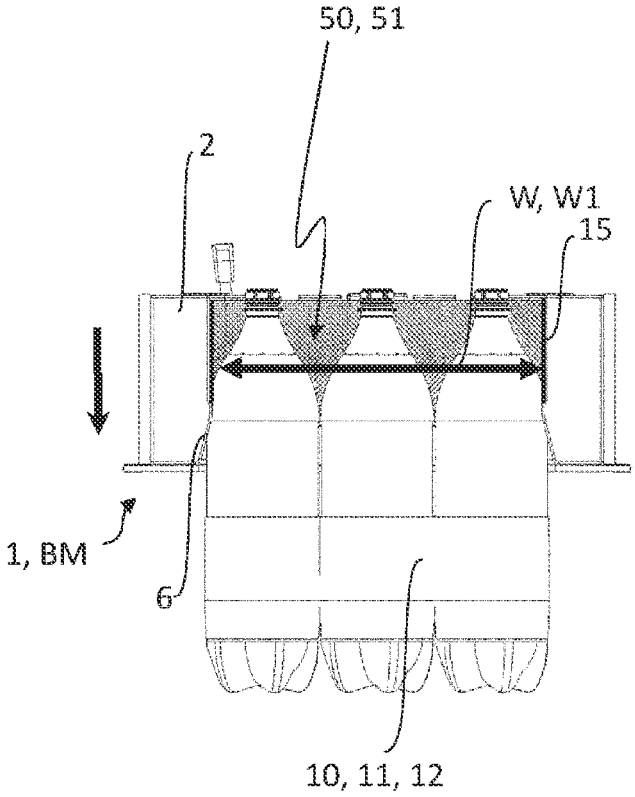
Figure 9:
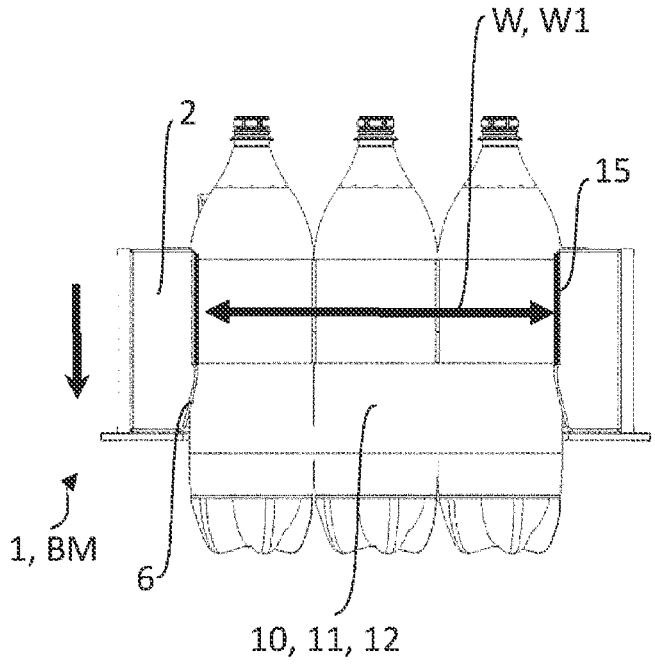
Figure 10:
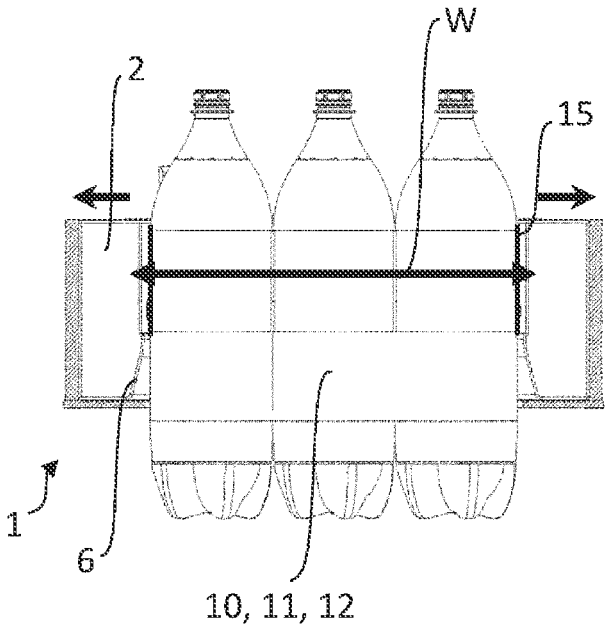

The defined lowering of the application head 1 according to FIG. 7 to 9 (or generally by the feed movement of the application head 1 toward the grouped articles 10) positions the strapping band 15 at a provided position of the articles 10. With increasing depth of the stroke, the compression applied to the lateral surfaces of the articles 10 increases until the desired compression is achieved. The stroke required for this purpose is defined and maintained by the design of the compression slope 6 on the contour pieces 2 of the application head 1. As the downward movement progresses, the inserted strapping band 15 is now pushed over the compressed article group 12.

When the desired position of the strapping band 15 is reached, the downward movement is stopped (FIG. 9).

The at least one strapping band 15 is now released and separated from its fixed position in the application head 1. In particular, the clamp between the strapping band 15 and the clamping pieces 3 and/or the suction connection between the strapping band 15 and the suction elements (not visible) is released to remove the fixing of the strapping band 15.

Subsequently or substantially simultaneously, the opening width W of the cage 50 of the application head 1 is increased in order to eliminate the compression between the cage 50 and the article group 12. After the separation of the application head 1, the strapped article group 12 forms a strapped package 13.

In particular, after the strapped package 13 has been produced, the cage 50 is opened by opening movements of individual segments of the cage 50 directed perpendicularly away from the lateral surface of the articles 10. For example, the contour pieces 2 are moved away from one another in the opposite direction of movement, as shown by the arrows in FIG. 10. In this case, the application head 1 is transferred to the release mode FM with a second opening width W2.

In particular, the contour elements 2 are moved away from the finished strapped package 13 by a movement perpendicular to the article longitudinal axis L, wherein a rotational movement and a combination of a rotational and translational movement are also conceivable. A distance between the compression surfaces formed by the compression slope 6 and the articles 10 is thereby produced, as a result of which the articles 10 are returned and a tension is produced with respect to the strapping band 15, as a result of which the necessary package stability is produced.

In particular, it is provided that the compression of the cage 50 is released as soon as the strapping band 15 has been stripped and is attached to the article group 12 at its intended target position and is positioned there with the intended pre-tension.

Depending on the arrangement of the fixing elements, in particular of the clamping elements 3, it may initially also be necessary, if for example the clamping elements 3 hold the strapping band 15 at the lower edge, to continue the downwardly directed movement of the application head 1 after the fixing has been released until the strapping band 15 is arranged outside the fixing region and only then, under certain circumstances, to release the compression of the articles 10 (FIG. 11). In addition, to release the compression, it may also be necessary to move the clamping elements 3 away from the strapped package 13, in order to avoid a collision when the application head 1 is lifted with that of the strapped package 13.

Figure 12:
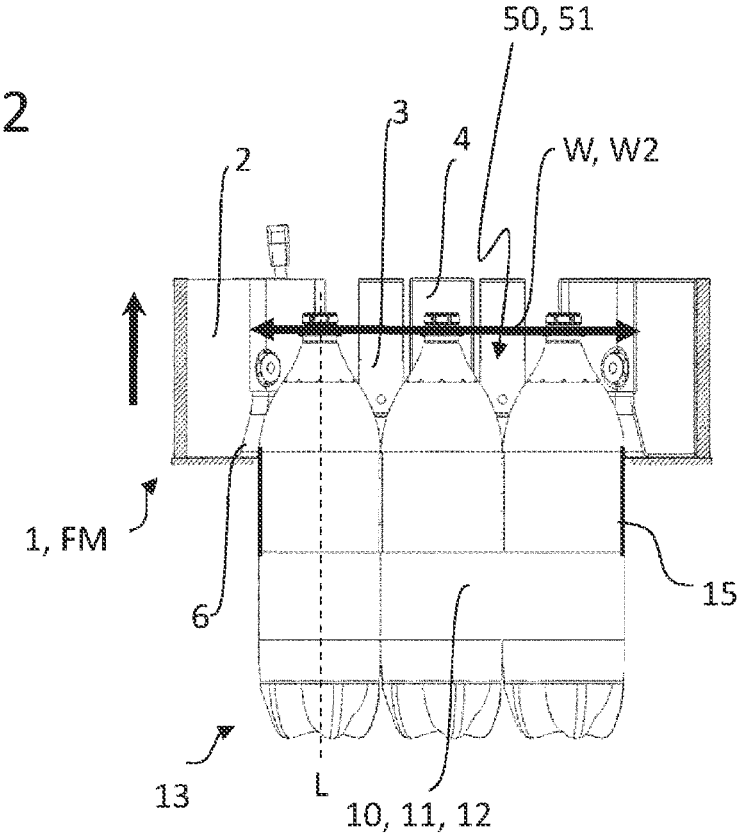

The application head 1 in release mode FM is removed from the strapped package 13 counter to the application direction and is moved back to an initial position, for example, for reloading with a strapping band 15 (FIG. 12). The strapped package 13 is released by lifting and can now be supplied for further handling, for example palletization or the like (not shown here).

After the strapped package 13 has been released, the application head 1 is transferred back to the operating mode BM by a corresponding feed movement of the contour pieces 2.

Preferably, the strapping band 15 is inserted into the application head 1 in such a way that the part of the strapping band 15 with the connection point, in particular the adhesive point or weld point or the like, is placed on a side of the strapping band arranged perpendicular to the subsequent transport direction of the strapped package 13. As a result, the connection point at which regions of the strapping band 15 can optionally overlap one another is prevented from hanging on guide strips of subsequent handling modules or the like, and the strapping band 15 is prevented from tearing accordingly.

Figure 13:
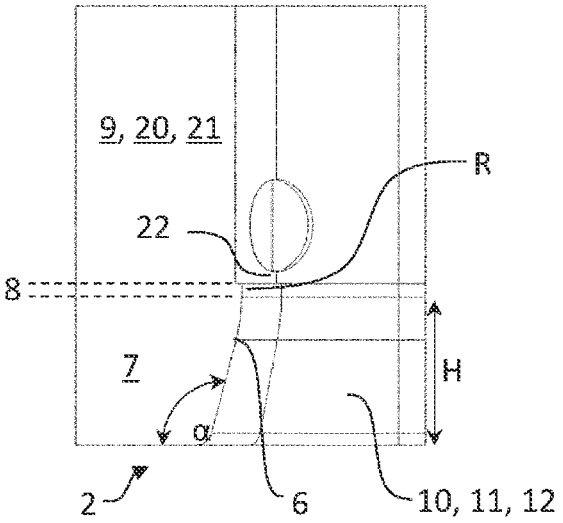
FIG. 13 to 15 show different views of a contour piece.
Figure 14:
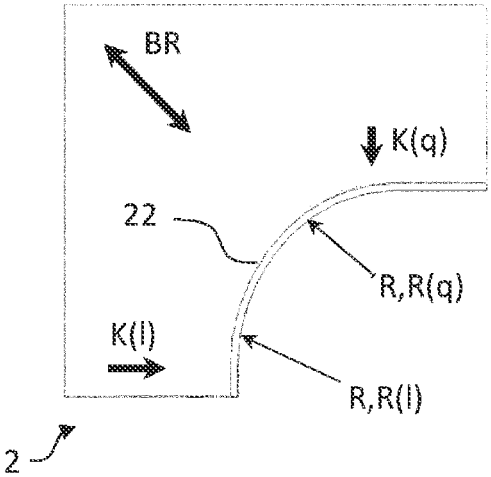
Figure 15:
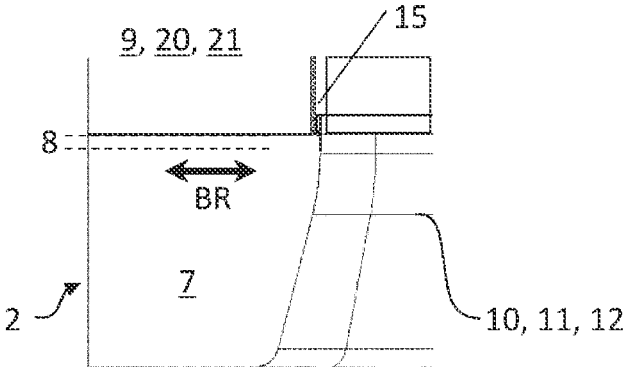

The schematic representations of FIG. 13 to 15 show different views of a contour piece 2 of an application head 1, as has already been shown and described above. In particular, FIGS. 13 and 15 are each a side view and FIG. 14 is a plan view of the contour piece 2.

The contour pieces 2 are shaped and designed such that, in the installed state, they have an insertion region 7, a compression region 8 and a region 9 set back behind the compression region 8 in the direction of the article longitudinal axis L (see FIGS. 2 and 12). The set-back region 9 is designed, in particular, as a vertical flash face 20 or undercut 21, which is intended to allow the strapping band to be guided to its intended position, without the contour pieces 2 being stripped prematurely.

The strapping band 15 is placed in the set-back region 9 of the contour piece 2 (FIG. 15). This is necessary in order to prevent the strapping band 15 from being placed on the contour of the articles 10, which could result in premature hanging of the strapping band 15 during the downward movement of the application head (cf. FIG. 6 to 9). In this case, the strapping band 15 could be overstretched or damaged, or correct application to the article group 12 could be prevented.

The circumference of the in particular prefabricated closed strapping band 15 is selected such that it is protected by the set-back region 9 or undercut 21, but is not larger than necessary. When the compression is released, a strapping band 15 would not achieve sufficient tension between the strapping band 15 and the article group 12, which is to be avoided. In particular, the friction between the articles 10 would be lost, which would result in reduced package stability. The useful length of the strapping band is thus determined by the overall circumference of the article grouping 12 and the deformability of the articles 10 in the grouping, which can ensure the strapping tension thereof after the strapping band is applied.

The compression applied to the individual articles 10 of the article group 12 is defined by the geometry of the contour piece 2 and the inner opening width of the cage 50 with the contour pieces 2 arranged therein. The amount of compression is defined by the difference between the compression radius R for the corresponding compression axis and the uncompressed article radius. The contour piece 2 can in particular have a radius R(l) for the compression K(l) longitudinally to the article group 12 and/or a radius R(q) for the compression K(q) transversely to the article group 12.

The compression is always applied in at least one direction to the respectively contacted articles 10 of the article group 12. In general, the compression K(l) is applied longitudinally to the article group 12. Alternatively, however, compression K(q) can also be applied transversely to the article group 12. A combination in both compression axes is also possible, i.e., a compression K(l) longitudinal to the article group 12 and a compression K(q) transverse to the article group 12. In this case, the contour piece 2 according to FIG. 5 is moved in the direction of movement BR shown by the movement arrow.

In the case of compression in only one axis, the inner contour 22 of the contour piece 2 is designed so that, starting from the compression radius R, the radius decreases to the uncompressed radius, so that the articles 10 are guided only in this axis. In the case of biaxial compression, the corresponding compression radii R(l) and R(q) can be selected to be different. In addition to the geometry of the contour pieces 2, an additional adjustment of the final compression can be carried out via a further infeed of the contour pieces 2 to the article group 12.

The selected shape and inclination of the insertion slope, referred to as compression slope 6, can influence how quickly the desired compression of the article group 12 is achieved. In particular, the selected shape also determines how much downward stroke of the application head 1 or what relative stroke is required in the direction of the article longitudinal axis relative to the article group 12. In addition, this also influences how much force must be applied for the compression, because, depending on the steepness of the compression slope 6, more or less friction is generated when the strapping unit 70 of the application head 1 is pushed onto the article group 12. Thus, by the height H of the insertion region 7 and the angle $\alpha$ of the compression slope 6, the geometry suitable for the corresponding group 12 can thus be designed, in particular depending on the desired compression, the article geometry and the corresponding friction pairings.

Preferably, the application head 1 is designed such that different articles 10 can also be processed with the same or similar article geometry, even if the opening width of the cage 50 differs from the base surface of the corresponding group 12. If the application head 1 is to be used for different basic dimensions of different article groups 12, the desired or technically required compression must be set by corresponding positioning of the contour pieces 2 in the longitudinal and transverse directions. In this way, defined similar diameter ranges can be covered in each instance.

The cage 50 provided by the strapping unit 70 of the application head 1 can also be enlarged or reduced and thus adapted to different pack sizes by optionally inserting further guiding and holding elements 4 or by removing guiding and holding elements 4.

The articles 10 are pushed between the strapping band 15 by the contour pieces 2 of the strapping unit 70 of the application head 1, wherein, due to the compression of the articles 10, there is initially a certain distance between the strapping band 15 held in the strapping unit 70 of the application head 1 and the article group 12. Thus, there is a spatial separation between the strapping band 15 and the articles 10, which is eliminated by the release of the compression.

Figure 16:
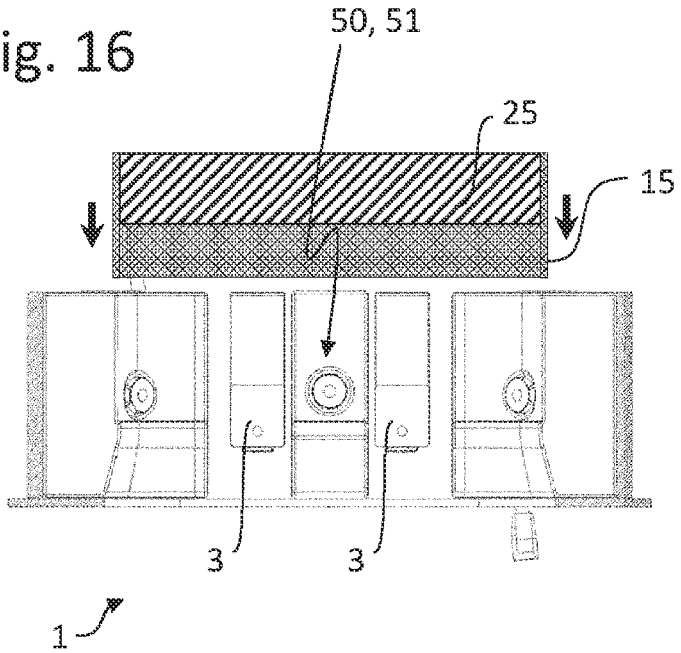
FIG. 16 to 21 show a transfer process of the strapping band to the application head.
Figure 17:
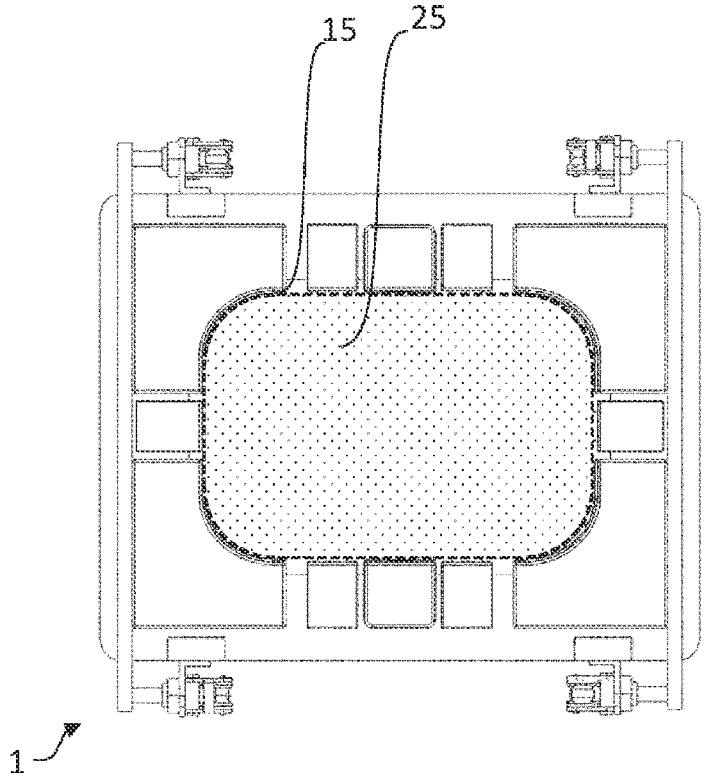
Figure 18:
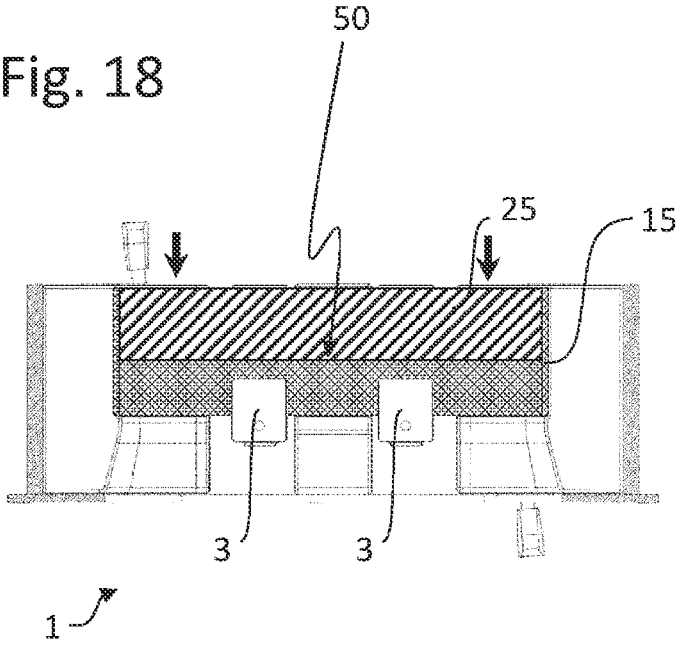
Figure 19:
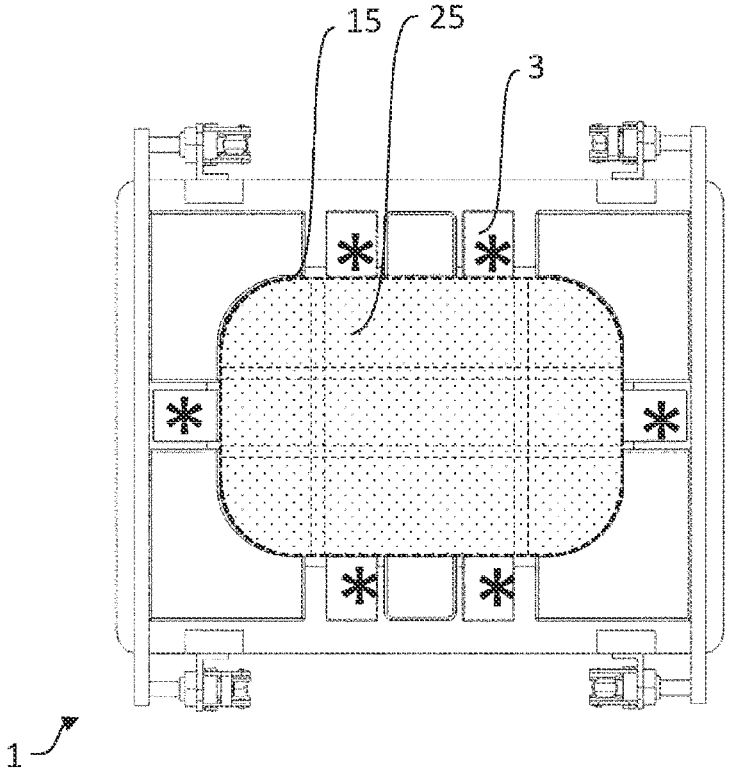
Figure 20:
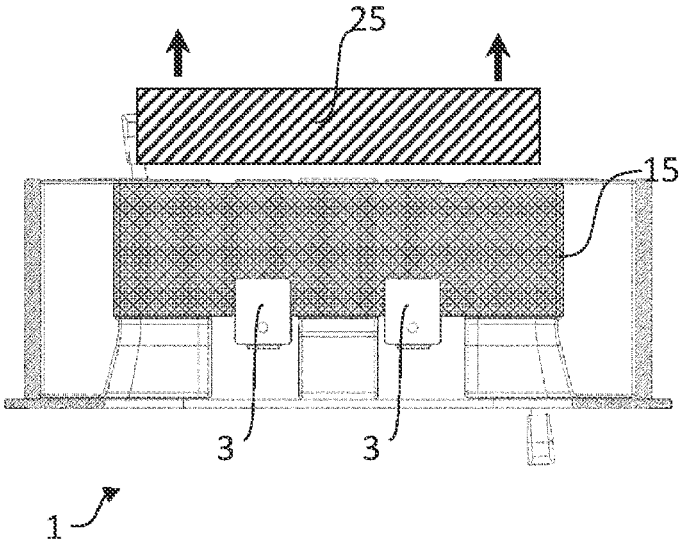
Figure 21:
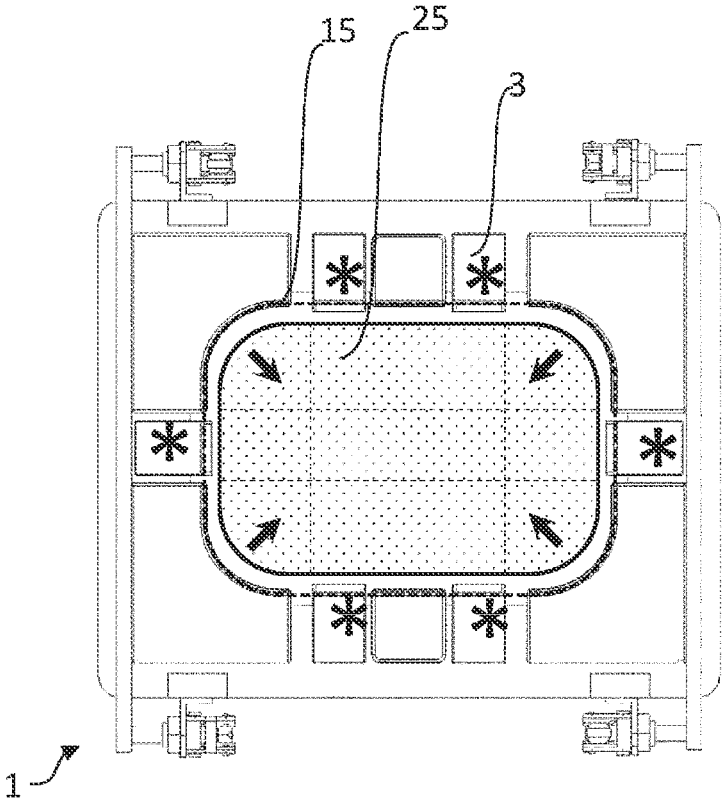

FIG. 16 to 21 show a transfer process of the prefabricated strapping band 15 to the application head 1, so that it can be made ready to apply the strapping to a prepared article group 12. In this case, FIGS. 16, 18 and 20 are each a side view of the application head 1, while FIGS. 17, 19 and 21 are corresponding views from above.

A transfer element 25, which has exactly or approximately the contour of the prefabricated strapping band 15 to be inserted, is used to insert the strapping band into the application head 1. The transfer element 25 takes the ring-shaped strapping band 15 from a corresponding preparation module (not shown). The transfer element 25 with the strapping band 15 is placed over the application head (FIGS. 16 and 17).

Preferably, the strapping band 15 is fixed to the transfer element 25 by suitable suction elements or clamping elements or other suitable fixing apparatuses, wherein the lower edge of the strapping band 15 preferably protrudes at the bottom beyond the transfer element 25, so that the lower region of the strapping band 15 can be inserted into the clamping elements 3 of the application head. If the strapping band 15 is held in the application head 1 by suction elements 5 only, a lower protrusion of the strapping band 15 beyond the transfer element 25 can be dispensed with. In addition, in this case it would also be possible for strapping band 15 to be inserted into the transfer element 25 from below.

By a downward movement of the transfer element 25 and/or an upward movement of the application head 1, the strapping band 15 is now placed in a desired arrangement within the application head 1 (FIGS. 18 and 19). By closing the clamping elements 3, as indicated and illustrated in FIGS. 19 and 21 by an asterisk, and/or by activating the suction elements 5 of the application head 1 and opening and/or deactivating corresponding fixing apparatuses of the transfer element 25, the strapping band 15 is transferred from the transfer element 25 to the application head 1.

The transfer element 25 is then removed by an upwardly directed movement of the transfer element or a downwardly directed movement of the application head 1 (FIGS. 20 and 21) and moved into a starting position for reloading with a further strapping band 15. In this case, it may be necessary to reduce the circumference of the transfer element 25, in order to allow for reliable removal from the application head 1. For this purpose, the transfer element 25 can be segmented, wherein the segments can be moved toward a center of the transfer element 25, as a result of which a reduction of the circumference of the transfer element 25 takes place.

It is particularly advantageous in the method described above that it is not necessary to adhere or otherwise fix the strapping band 15 to the article group 12. By using the correspondingly designed application head 1, the complexity of the strapping process can be reduced.

Figure 22:
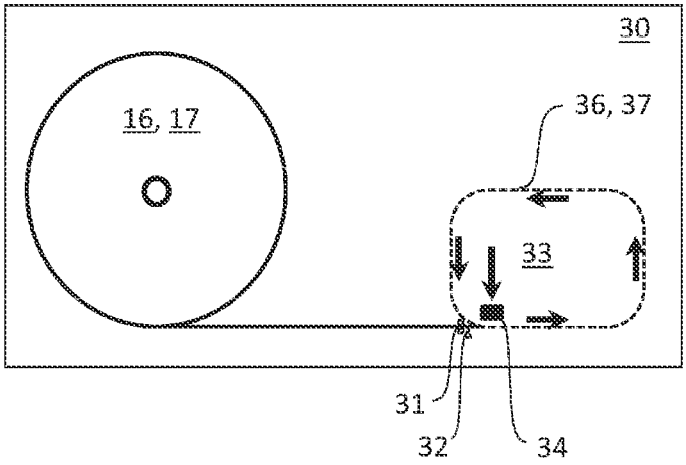
FIGS. 22 and 23 show a pre-production of the strapping band.
Figure 23:
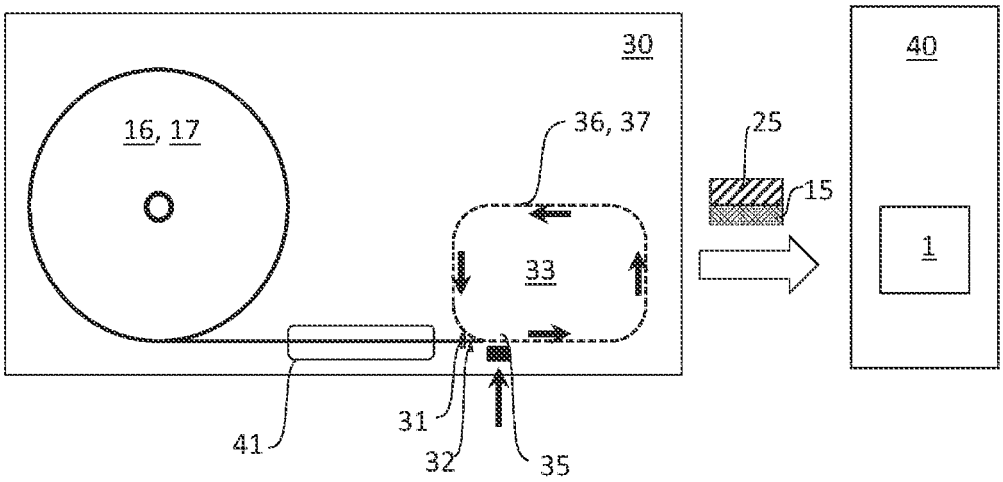

The schematic views of FIGS. 22 and 23 show the pre-production of the strapping band 15 in a preparation module 30. In this case, an endless strapping material 16 is provided, for example, as a reeled material 17 in a required width. This is fed in a corresponding preparation module 30 via a feed apparatus 31 to a separating apparatus 32.

The feed apparatus 31 can consist, for example, of two oppositely rotating rubberized rollers that unwind the reeled material 17 accordingly. The separating apparatus 32 consists, for example, of a downstream knife or other suitable cutting unit.

The separating apparatus 32 cuts strapping material 16 to a defined length, and the free end regions of the strapping material 16 cut to length are connected to one another to form the ring-shaped, prefabricated strapping band 15. In particular, the free end regions are thereby arranged partially overlapping and are connected to one another by gluing or a welding process or the like.

In the embodiment shown, a gluing unit 33 is shown, comprising a glue application apparatus 34 and a contact pressure apparatus 35 to form an adhesive connection.

A frame 36 is associated with the gluing unit 33, which frame maps the desired circumference of the strapping band 15 to be formed in a recess. Furthermore, a circulating conveying unit 37 associated with the frame 36 is provided. The frame 36 can be segmented and, by adjusting individual frame segments, the frame circumference and thus the circumference of the strapping band 15 to be formed can be adjusted.

This makes it possible to react to any circumferential variation of the article groups or to perform a format change with the same strapping material 16.

To transport the strapping material 16 along an inner or an outer contour of the frame 36, one or more vacuum belts and/or mechanical conveying elements, for example circulating clamping elements, rubberized belts, conveyor belts or the like can be used.

The strapping material 16 is conveyed once around the entire inner or outer contour of the frame 36 by the conveying unit 37 until an overlap is formed in the region of the gluing unit 33.

The cut-to-length strip of strapping material 16 is provided with glue at the starting region and/or at the end region by the glue application apparatus 34, the starting region and the end region are arranged overlapping one another and then pressed out by a contact pressure die of the contact pressure apparatus 35, thereby creating a load-bearing connection.

The correspondingly closed strapping band 15 can now be picked up by a transfer element 25 in the manner described above and supplied to the application head 1 of an application device 40 for strapping an article group. The application device 40 has a movement and/or handling area for the application head 1 for cooperation with at least two articles grouped within the movement and/or handling area.

With the arrangement of such a preparation module 30, changes in the article groups can be responded to in an inline manner. If the format changes, only the material needs to be changed if a different width of the strapping material 16 is necessary. The costs for the preparation module 30 are quickly recouped, because strapping material 16 provided on rolls is much less expensive than specially prefabricated closed strapping bands 15.

Figure 24:
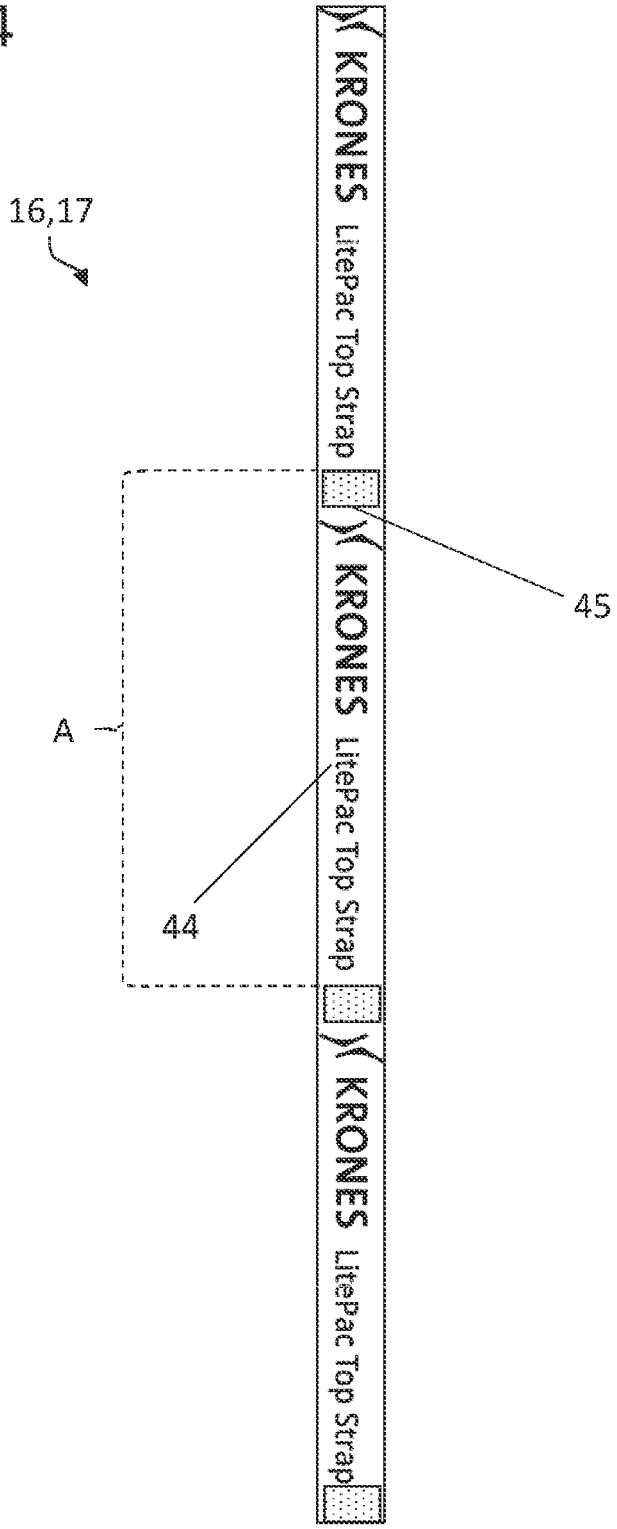
FIG. 24 shows inline printing during the formation of a strapping band.

The schematic view of FIG. 24 shows so-called inline printing during the formation of a strapping band 15, which is provided as an endless reeled material 17 according to FIGS. 22 and 23. In particular, it is provided that a type of scattered print 44 is applied as a basic print design on the reeled material 17. This is a printed image that repeats at a defined interval A. Ideally, the interval A is designed in such a way that it results in at least a complete repetition of the pattern per length of a strapping band 15 for all formats to be processed, in particular package circumferences, in the corresponding width of the strapping material 16.

If, in addition, a package-specific print is to be present on the strapping band 15 to be formed, at least one empty field 45 is designed as a component of the scattered print 44. In this empty field 45, the desired printing can take place in an inline manner, for example in the form of a barcode, format information, best-before date, etc. For this purpose, in particular a printing unit 41 (FIG. 23) arranged in the preparation module 30 can be provided, so that the desired printing takes place as part of the formation of the closed strapping band 15. Alternatively, a corresponding printing unit can also be associated with the application device 40, wherein the printing can take place before the closed strapping band 15 is applied to the grouped articles or after the strapped package has been formed.

The inline print can be positioned within the empty fields 45 by evaluating the unrolled length and back-calculating of the position of the empty field 45 to be printed. Alternatively, sensor detection of the empty field or other markings present on the strapping material 16 can be provided. For example, the detection of a special geometric marking that is a component of the scattered print 44 is conceivable.

The advantage of such inline printing is that it reduces the amount of strapping material 16 required because it can now be used flexibly. This further reduces material costs because the same strapping material 16 can be used for different products.

The embodiments, examples and variants of the preceding paragraphs, the claims or the following description and the figures, including their various views or respective individual features, may be used independently of one another or in any combination. Features described in connection with an embodiment are applicable for all embodiments provided the features are not incompatible.

If in the context of the description of the figures above reference is also generally made to "schematic" representations and views, this in no way means that the figure representations and their description are to be of subordinate importance with regard to the disclosure of the invention. The person skilled in the art is certainly able to derive sufficient information from the schematically and abstractly drawn representations that will make it easier for the person skilled in the art to understand the invention without being confused in any way by the drawn and possibly not exactly true-to-scale proportions of the articles and/or parts of the application device or other drawn elements. The figures enable the person skilled in the art as reader to get a better understanding of the inventive idea, which has been formulated more generally and/or more abstractly in the claims and in the general part of the description, on the basis of the more specifically explained implementations of the method according to the invention and the more specifically explained mode of operation of the device according to the invention.

The invention has been described with reference to a preferred embodiment. However, it is conceivable for a person skilled in the art that modifications or changes can be made to the invention without departing from the scope of protection of the following claims.

| List of Reference Signs | |
|---|---|
| 1 | application head |
| 2 | contour piece |
| 3 | clamping element |
| 4 | guide or holding element |
| 5 | suction element |
| 6 | compression slope |
| 7 | insertion region |
| 8 | compression region |
| 9 | reset region |
| 10 | article |
| 11 | bottle |
| 12 | article group |
| 13 | strapped package |
| 15 | strapping band |
| 16 | strapping material |
| 17 | reeled material |
| 20 | vertical flash face |
| 21 | undercut |
| 22 | inner contour |
| 25 | transfer element |
| 30 | preparation module |
| 31 | feed apparatus |
| 32 | separating apparatus |
| 33 | gluing unit |
| 34 | glue application apparatus |
| 35 | contact pressure apparatus |
| 36 | frame |
| 37 | circumferential conveying unit |
| 40 | application device |
| 41 | printing unit |
| 44 | scattered print |

-continued

| List of Reference Signs | |
|---|---|
| 45 | empty field |
| 50 | cage |
| 51 | contoured guide |
| 55 | first frame element |
| 56 | second frame element |
| 57 | adjustment devices |
| 58 | adjustment devices |
| α | angle |
| A | distance |
| BM | operating mode |
| BR | direction of movement |
| FM | release mode |
| H | height |
| K(l) | (first) compression longitudinally to the article group |
| K(q) | (second) compression transversely to the article group |
| L | article longitudinal axis |
| M | center point |
| R | compression radius |
| R(l) | (first) longitudinal radius for compression |
| R(q) | (second) transverse radius for compression |
| W | opening width |
| W1 | opening width in operating mode |
| W2 | opening width in release mode |

The invention claimed is:

1. A method for producing strapped packages (13), each of which is made of at least two grouped articles (10) that are held together by at least one strapping band (15), comprising:

a) providing the at least two grouped articles (10), which are positioned in a movement or handling area of an application head (1), b) inserting at least one prefabricated closed strapping band (15) into the application head, wherein the at least one strapping band (15) is fixed in a defined position, and the application head (1) has a cage (50), with a variable opening width (W), that can surround the at least two grouped articles (10), c) feeding the application head (1) equipped with the at least one strapping band to the grouped articles by a feed movement which runs approximately parallel to longitudinal central axes of the grouped articles or wherein the grouped articles (10) can be fed to the application head (1) by a feed movement which runs approximately parallel to longitudinal central axes (L) of the grouped articles (10), wherein the cage of the application head contacts the grouped articles on the outer surface thereof and at least slightly compresses the grouped articles, d) positioning the strapping band (15) on the grouped articles (10) by lowering the application head (1), which is simultaneously compressing the articles (10), e) increasing the opening width (W) of the cage (50) of the application head (1) while the at least one strapping band (15) is simultaneously released and removed from its fixed position within the application head (1), f) removing the application head (1) from the strapped article grouping (12).

2. The method of claim 1, wherein the cage (50) comprises a contoured guide (51) on its inner circumference, which is formed at the corner radii, or wherein the inner contour of the cage (50) is beveled in the lowering direction onto the grouped articles (10).

3. The method of claim 2, further comprising eliminating the compression by the cage (50) once the strapping band (15) is positioned at its target position on the grouped articles (10).

4. The method of claim 3, further comprising opening the cage (50) by opening movements of individual segments of the cage (50) directed perpendicularly away from the outer surface of the grouped articles (10).

5. The method of claim 4, further comprising arranging the at least one strapping band (15) in an undercut (21) of the cage (50) when inserted into the cage (50) of the application head (1).

6. The method of claim 5, further comprising producing the closed strapping band (15) from a strapping material (16) provided in strip form and is arranged and temporarily fixed immediately thereafter in the application head (1).

7. An application device (40) for producing strapped packages (13), each of which is made of at least two grouped articles (10) that are held together by at least one strapping band (15), comprising:

an application head (1) comprising a cage (50) having a variable opening width (W) and a region for inserting at least one prefabricated closed strapping band (15), wherein the cage (50) can surround the grouped articles (10), wherein the application head (1), together with the at least one strapping band (15) fixed therein, can be fed over the grouped articles (10) located in a movement or handling area of the application head (1) by a feed movement which runs approximately parallel to longitudinal central axes (L) of the grouped articles (10), or wherein the grouped articles (10) can be fed to the application head (1) a feed movement which runs approximately parallel to longitudinal central axes (L) of the grouped articles (10), wherein the cage (50) contacts the grouped articles (10) on the outer surface thereof and at least slightly compresses the grouped articles, and wherein the cage (50) can be opened while the at least one strapping band (15) is simultaneously released and removed from its fixed position within the application head (1).

8. The application device (40) of claim 7, wherein the cage (50) comprises fixing apparatuses (3, 5) for the strapping band (15).

9. The application device (40) of claim 8, wherein the fixing apparatuses (3, 5) comprise vacuum grippers or adhesion grippers.

10. The application device (40) claim 7, wherein the cage (50) has a contoured guide (51) on its inner circumference, which is formed at the corner radii, or wherein the inner contour of the cage (50) is beveled in the feed direction onto the grouped articles group (10).

11. The application device (40) of claim 10, wherein the cage (50) comprises at least one undercut (21) in which the strapping band (15) is arranged after insertion into the cage (50).

12. The application device (40) of claim 7, wherein the cage (50) can be opened by opening movements of individual segments of the cage (50) directed perpendicularly away from the lateral surface of the grouped articles (10).

13. A packaging device for producing strapped packages (13), each of which is made of at least two grouped articles (10) that are held together by at least one strapping band (15), wherein the packaging device comprises an application device (40) having:

an application head (1) comprising a cage (50) having a variable opening width (W) and a region for inserting at least one prefabricated closed strapping band (15), wherein the cage (50) can surround the grouped articles (10), wherein the application head (1), together with the at least one strapping band (15) fixed therein, can be fed over the grouped articles (10) located in a movement or handling area of the application head (1) by a feed movement which runs approximately parallel to longitudinal central axes (L) of the grouped articles (10), or wherein the grouped articles (10) can be fed to the application head (1) by a feed movement which runs approximately parallel to longitudinal central axes (L) of the grouped articles (10), wherein the cage (50) contacts the grouped articles (10) on the outer surface thereof and at least slightly compresses the grouped articles, and wherein the cage (50) can be opened while the at least one strapping band (15) is simultaneously released and removed from its fixed position within the application head (1).

14. The packaging device of claim 13, further comprising a preparation module (30) for producing closed strapping bands (15) comprising:

a magazine in which a supply of strapping material (16) in strip form is provided, a connecting device (33) for connecting free ends of the strapping material (16) in strip form to form a closed strapping band (15).

* * * * *